United States Patent [19]

Wüthrich

[11] Patent Number: 4,654,494

[45] Date of Patent: Mar. 31, 1987

[54] ACTUATING MECHANISM FOR AN ELECTRICAL SWITCH WITH PRESSURE CONTACTS, ESPECIALLY FOR A VACUUM SWITCH

[75] Inventor: Hans-Rudolf Wüthrich, Oberentfelden, Switzerland

[73] Assignee: Sprecher & Schuh AG, Aarau, Switzerland

[21] Appl. No.: 754,006

[22] Filed: Jul. 11, 1985

[30] Foreign Application Priority Data

Aug. 31, 1984 [CH] Switzerland ..... 4167/84

[51] Int. Cl.[4] ..... H01H 33/42

[52] U.S. Cl. ..... 200/337; 200/144 B; 74/99 R; 74/100 R

[58] Field of Search ..... 200/337, 144 B; 74/110, 74/99 R, 100 R, 104, 105, 97

[56] References Cited

U.S. PATENT DOCUMENTS 4,593,165 6/1986 Steinemer ..... 200/144 B

FOREIGN PATENT DOCUMENTS 3147016 6/1983 Fed. Rep. of Germany ... 200/144 B

*Primary Examiner*—James E. Bryant, III
*Assistant Examiner*—Renee S. Luebke
*Attorney, Agent, or Firm*—Werner W. Kleeman

[57] ABSTRACT

A reciprocatingly movable actuating rod is coupled to a longitudinally translatable contact plunger through a linkage and a stationarily arranged S-shaped guideway. A compression spring which is compressible during the course of a switching engagement stroke also acts upon the contact plunger. In order to keep especially the contact plunger as free as possible from transverse forces during the switching stroke and to keep the actuating rod unloaded both in the engaged position and in the disengaged switching stroke position, one end of the actuating rod, which extends perpendicular to the direction of motion of the contact plunger, carries a journal pin engaging the guideway. One end of a connecting rod included in the linkage is pivotably connected to the journal pin. The other end of the connecting rod is pivotably connected to the contact plunger through an entrainment sleeve. The compression spring, which pivots conjointly with the connecting rod, is supported at one end on the connecting rod and at the other end on a coupling sleeve defining the entrainment sleeve on the contact plunger. The guideway is configured such that it has end regions respectively associated with the engaged and disengaged switching stroke positions and which extend perpendicular to the connecting rod.

8 Claims, 2 Drawing Figures

ACTUATING MECHANISM FOR AN ELECTRICAL SWITCH WITH PRESSURE CONTACTS, ESPECIALLY FOR A VACUUM SWITCH

BACKGROUND OF THE INVENTION

The present invention broadly relates to switch actuating mechanisms and, more specifically, pertains to a new and improved construction of an actuating mechanism for an electrical switch with pressure contacts, especially for a vacuum switch.

Generally speaking, the actuating mechanism of the present invention is for an electrical switch having pressure contacts and especially for a vacuum switch having pressure contacts and comprises: means for longitudinally translatably guiding a contact plunger of the electrical switch in the direction of a switching stroke; a reciprocatingly drivable actuating rod having at least one end; a connecting rod having a first end and a second end; slide means for pivotably interconnecting the end of the actuating rod and the first end of the connecting rod; pivot means for pivotably interconnecting the contact plunger and the second end of the connecting rod; a stationary guideway engaging the slide means for constraining a joint path of motion of the end of the actuating rod and the first end of the connecting rod; and a compression spring acting upon the contact plunger and arranged to be compressed by an engagement position of the switching stroke of the contact plunger.

An actuating mechanism of this type is known, for instance from the German Petty Patent No. 8,109,229, published Aug. 6, 1981. In this known actuating mechanism the linkage comprises a bell crank. An S-shaped guideway is formed in the end region of one arm of this bell crank. A stationarily anchored pin engages in this S-shaped guideway and an actuating rod is pivotably connected to the end of the other arm. The pivot axis of the bell crank is fastened to a plunger which is longitudinally translatable coaxially with the contact plunger, which is also longitudinally translatable. When the bell crank is pivoted, its pivot axis is raised or lowered since the stationary pin engages in the S-shaped guideway. When the stationary pin is in the middle region of the S-shaped guideway, i.e. the actuating mechanism is situated between the engagement position and the disengagement position or vice versa, the counterforce generated by the compression spring surrounding the plunger generates, in cooperation with the S-shaped guideway, shearing forces on the pivot axis of the bell crank fastened to the plunger. The shearing forces must not only be taken up by this pivot axis but also by the guide ends of the plunger and furthermore load the plunger in bending.

In relation to the shearing forces acting on the plunger, analogous remarks apply to the actuating mechanism for a vacuum switch which is to be found in the U.S. Pat. No. 4,225,765, granted Sept. 30, 1980. This actuating mechanism does not comprise an S-shaped guideway.

SUMMARY OF THE INVENTION

Therefore, with the foregoing in mind it is a primary object of the present invention to provide a new and improved construction of an actuating mechanism for an electrical switch which does not exhibit the aforementioned drawbacks and shortcomings of the prior art constructions.

Another and more specific object of the present invention aims at providing a new and improved construction of an actuating mechanism of the previously mentioned type which does not require a bell crank and therefore requires less mechanical expenditure and in which the forces arising during a switching stroke, especially the shear and transverse forces, can be more readily controlled.

Yet a further significant object of the present invention aims at providing a new and improved construction of an actuating mechanism of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the actuating mechanism of the present invention is manifested by the features that: the actuating rod extends substantially perpendicular to the , direction of the switching stroke of the contact plunger; the slide means comprise a journal member mounted in the end of the actuating rod; the pivot means comprise entrainment means for entraining the contact plunger; the compression spring pivots conjointly with the connecting rod and has a first end and a second end; the connecting rod supports the first end of the compression spring near the slide means; a coupling sleeve defining the entrainment means is provided; the contact plunger supports the compression spring through the coupling sleeve; and the stationary guideway has a region associated with the engagement position of the switching stroke and configured such that it extends substantially perpendicular to the connecting rod when the contact plunger is in the engagement position of the switching stroke.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
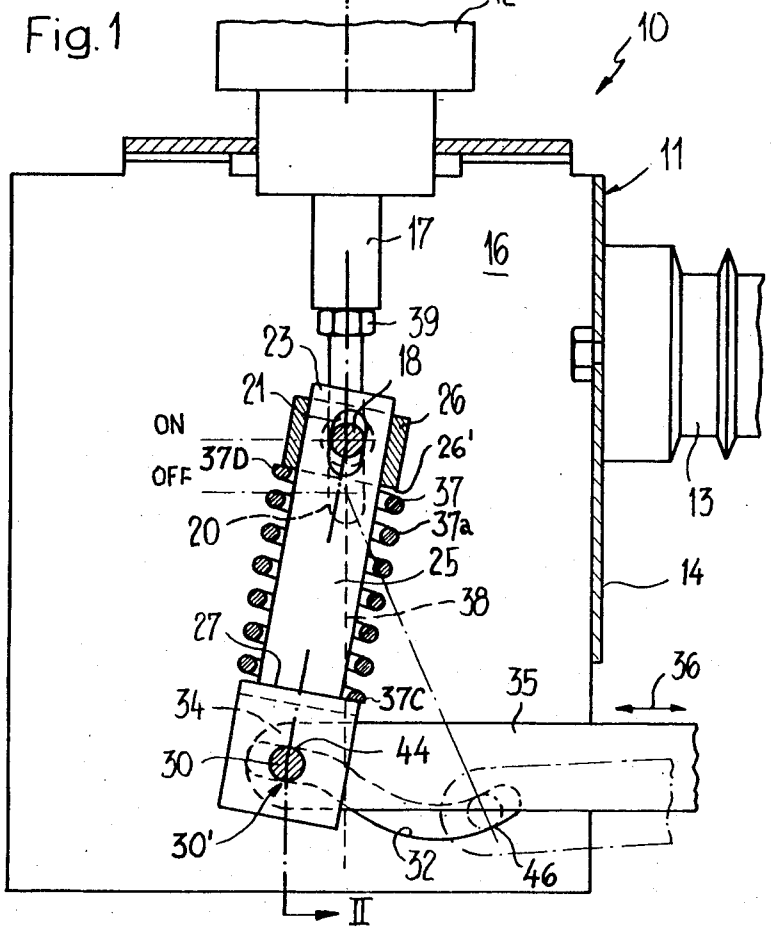
FIG. 1 schematically shows a partial section taken of the switch actuating mechanism and along the line I—I of FIG. 2.

Describing now the drawings, it is to be understood that to simplify the showing thereof only enough of the structure of the actuating mechanism for an electrical switch has been illustrated therein as is needed to enable one skilled in the art to readily understand the underlying principles and concepts of this invention. Turning now specifically to FIG. 1 of the drawings, the actuating mechanism 10 illustrated therein by way of example and not limitation will be seen to comprise a substantially box-like housing 11 upon which an only partially visible vacuum switch tube 12 of a vacuum switch is supported. The housing 11 is anchored to the rear wall of a not particularly shown drive mechanism by a supporting insulator 13. The supporting insulator 13 is anchored to an end face 14 of the housing 11, while opposing first and second side walls of the latter are respectively designated by the reference numerals 15 and 16.

A contact plunger 17 which carries the not particularly shown switch contact is longitudinally translatably and vacuum-tightly conducted out of the vacuum switch tube 12 defining guide means for the contact plunger 17 and which contains the switch contacts of the vacuum switch. An outer or lower free end 17' of the contact plunger 17 carries pivot means 40 comprising a guide pin 18 extending substantially perpendicular to the contact plunger 17. The guide pin 18 has a first end 18A and a second end 18B which ends extend through respective first and second longitudinal guide slots 19 and 20 extending substantially parallel to the direction of motion or the direction of the switching stroke of the contact plunger 17 and these guide slots 19 and 20 are situated in the side walls 15 and 16, respectively. The guide pin 18 is secured with its first and second ends 18A and 18B in the respective first and second longitudinal guide slots 19 and 20, for instance by means of cotter keys 21' or similar securing elements.

A connecting rod 25 has a second forked or slotted end 25' comprising arms 23 and 24. The connecting rod 25 is pivotably connected to the guide pin 18 through longitudinally extending slots 21 and 22 formed in the arms 23 and 24, respectively. The second forked end 25' of the connecting rod 25 is surrounded by entrainment means 42 which are associated with the pivot means 40 and comprise a coupling sleeve or entrainment sleeve 26. This entrainment or coupling sleeve 26—also sometimes known as a drag sleeve—is transversely penetrated without play by the guide pin 18. The first or lower end 25" of the connecting rod 25 has a shoulder 27 and is also forked or slotted. Two arms 28 and 29 on the first or lower forked end 25" of the connecting rod 25 are penetrated without play by slide means 30' comprising a journal pin or member 30 extending substantially parallel to the guide pin or member 18. The journal pin 30 extends with its first and second ends 30A and 30B or engages respective two mutually congruent S-shaped first and second guide slots 31 and 32 formed in the opposing first and second side walls 15 and 16, respectively. The journal pin or member 30 is secured in the guide slots 31 and 32 by cotter keys 33. Both substantially S-shaped guide slots 31 and 32 conjointly form a substantially S-shaped stationary guideway.

The two arms 28 and 29 of the first or lower forked end 25" of the connecting rod 25 partially surround one end 34 of an actuating rod 35 made of electrically insulative material. The journal pin or member 30 is pressed into the end 34 of the actuating rod 35 and extends through said first or lower end 25" and protrudes beyond a first side 28A and a second side 29A of such first or lower end 25" of the connecting rod 25. The actuating rod 35 is reciprocatingly translatable in the direction of the double-headed arrow 36 by means of a not particularly shown suitable drive unit.

Figure 2:
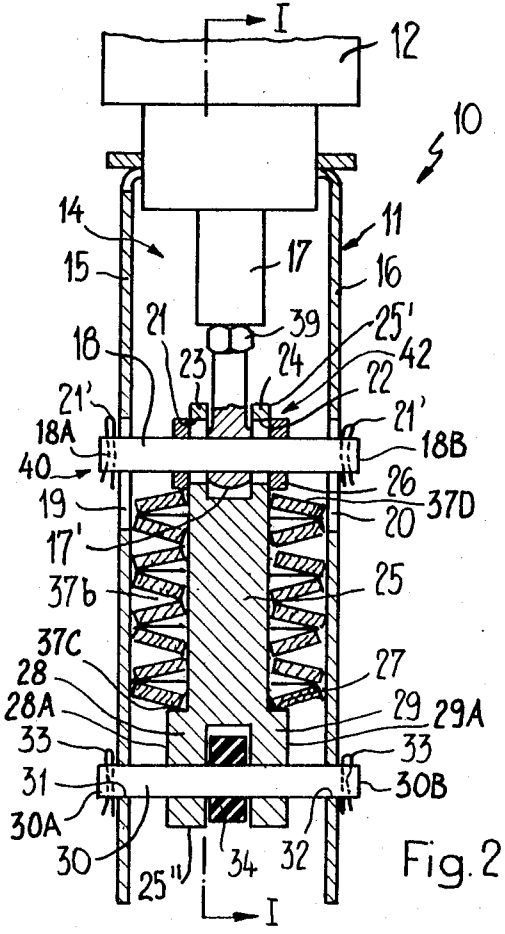
FIG. 2 schematically shows a partial section of the arrangement of FIG. 1 taken along the line II—II thereof and showing a modified detail.

The connecting rod 25 is surrounded by a compression spring 37. This compression spring 37 may comprise a coil spring 37*a* (FIG. 1) or a Belleville spring washer package 37*b* (FIG. 2). The compression spring 37 is supported at a first end 37*c* at the shoulder 27 formed at the first or lower end 25" of the connecting rod 25 and at a second end 37*d* at a lower end face 26' of the entrainment or coupling sleeve 26. The compression spring 37 thus acts through the entrainment or coupling sleeve 26 and through the guide pin 18 upon the contact plunger 17. The entrainment or coupling sleeve 26 is pivotable in relation to the contact plunger 17 but not axially translatable.

The engagement position of the switch stroke is shown in solid lines in FIG. 1. It will be seen that the guide pin 18 does not bear against the lower end of the longitudinally extending slots 21 and 22. The connecting rod 25 is therefore not loaded. The compression spring 37, which is compressed in the engagement position, acts upon the entrainment or coupling sleeve 26 and through the latter upon the guide pin 18. Due to the longitudinally extending slots 21 and 22, the guide pin 18 can only move in a direction substantially parallel to the direction of motion of the switching stroke of the contact plunger 17. This means that, although the compression spring 37 is oriented at an angle to the contact plunger 17 in the engagement position, the contact plunger 17 is only subjected to a component of force effective in its direction of translation or the direction of the switching stroke, while the force component directed transversely thereto is supported through the first and second ends 18A and 18B of the guide pin 18 by the respective first and second longitudinally extending guide slots 19 and 20. The contact plunger 17 is not subjected to any bending load.

If the actuating rod 35 is pulled to the right in FIG. 1 into the disengagement position shown in chain-dotted line, the first or lower end 25" of the connecting rod 25 follows the configuration of the two substantially S-shaped guide slots 31 and 32 defining the stationary guideway while pivoting about the guide pin 18. The compression spring 37 relaxes to some extent but not completely and, since the guide pin 18 comes to bear against the upper ends of the longitudinally extending slots 21 and 22, the guide pin 18 is also pulled downwardly and with it the contact plunger 17.

It is to be noted that predetermined regions 44 and 46 of the stationary guideway or two S-shaped guide slots 31 and 32 which correspond to the engaged and disengaged positions, respectively, of the switching stroke extend substantially perpendicular to the orientation of the connecting rod 25 in the respective position of the switching stroke. This, however, means that both in the engaged and in the disengaged position of the switching stroke the actuating rod 35 remains unloaded.

It is particularly advantageous for the actuating mechanism 10 to be designed such that the contacts of the vacuum switch enter mutual engagement when the connecting rod 25 is in a position which is aligned with the direction of translation or the direction of the switching stroke of the contact plunger 17, as indicated by the dashed line 38 in FIG. 1. This can, for instance, be adjusted by altering the length of the portion of the contact plunger 17 protruding from the vacuum switch, for instance by means of an adjusting nut 39.

It is also advantageous to select the relaxed length of the compression spring 37 such that this compression spring 37 is already preloaded in the disengagement position of the switching stroke and is further compressed or loaded during the switching stroke into the engagement position when the connecting rod 25 (coming from the right as seen in FIG. 1) approaches the position indicated by the dashed line 38. Correspondingly, a flat, i.e. relatively constant, spring characteristic results and the contact pressure is even ensured when the switch contacts are burned, without requiring the actuating or drive unit driving the actuating rod 35 to exert a greater drive effort.

While there are shown and described present preferred embodiments of the invention, it is to be distinctly understood that the invention is not limited thereto, but may be otherwise variously embodied and practiced within the scope of the following claims. Accordingly,

What I claim is:

1. An actuating mechanism for an electrical switch having pressure contacts, especially for a vacuum switch having pressure contacts, comprising:

means for longitudinally translatably guiding a contact plunger of the electrical switch in a predetermined direction of a switching stroke;

a reciprocatingly drivable actuating rod having at least one end;

a connecting rod having a first end and a second end;

slide means for pivotably interconnecting said at least one end of said actuating rod and said first end of said connecting rod;

pivot means for pivotably interconnecting said contact plunger and said second end of said connecting rod;

a stationary guideway engaging said slide means for constraining a joint path of motion of said at least one end of said actuating rod and said first end of said connecting rod;

a compression spring acting upon said contact plunger and arranged to be increasingly compressed under the action of said actuating rod and said slide means in an engagement position of said switching stroke of said contact plunger;

said actuating rod extending substantially perpendicular to said predetermined direction of said switching stroke of said contact plunger;

said slide means comprising a journal member mounted in said at least one end of said actuating rod;

said pivot means comprising entrainment means for entraining said contact plunger;

said compression spring pivoting conjointly with said connecting rod and having a first end and a second end;

said connecting rod supporting said first end of said compression spring near said slide means;

said entrainment means comprising a coupling sleeve;

said contact plunger supporting said compression spring through said coupling sleeve;

said stationary guideway having a predetermined region assoicated with said engagement position of said switching stroke; and said stationary guideway being configured such that said predetermined region thereof extends substantially perpendicular to said connecting rod when said contact plunger is in said engagement position of said switching stroke.

2. The actuating mechanism as defined in claim 1, wherein:

said compression spring comprises a coil spring surrounding said connecting rod.

3. The actuating mechanism as defined in claim 1, wherein:

said compression spring comprises a spring washer stack surrounding said connecting rod.

4. The actuating mechanism as defined in claim 1, further including:

a housing comprising a first wall and a second wall opposite said first wall;

said first end of said connecting rod at least partially surrounding said actuating rod;

said first end of said connecting rod having a first side and a second side;

said journal member protruding beyond each of said first side and said second side of said first end of said connecting rod;

said journal member having a first end and a second end;

said stationary guideway comprising a first guide slot formed in said first wall of said housing and a second guide slot formed in said second wall of said housing; and said first end of said journal member engaging said first guide slot and said second end of said journal member engaging said second guide slot.

5. The actuating mechanism as defined in claim 4, wherein:

said first guide slot and said second guide slot of said stationary guideway are each configured such that said compression spring is more greatly compressed before said engagement position of said switching stroke is attained than it is when said engagement position of said switching stroke is attained.

6. The actuating mechanism as defined in claim 1, wherein:

said contact plunger has an outer end;

said pivot means comprising a guide pin fastened to said outer end of said contact plunger and extending substantially perpendicular thereto as well as substantially parallel to said journal member;

said connecting rod having at said second end thereof at least one longitudinally extending slot penetrated by said guide pin;

said guide pin having a first end and a second end;

a first longitudinal guide slot and a second longitudinal guide slot both extending substantially parallel to said direction of said switching stroke of said contact plunger; and said first end of said guide pin being guided in said first longitudinal guide slot and said second end of said guide pin being guided in said second longitudinal guide slot.

7. The actuating mechanism as defined in claim 6, wherein:

said second end of said connecting rod is forked and is surrounded by said coupling sleeve;

said guide pin penetrating said coupling sleeve transversely and substantially free of play;

said coupling sleeve having at least one end face; and said at least one end face of said coupling sleeve supporting said second end of said compression spring.

8. The actuating mechanism as defined in claim 6, further including:

a housing comprising a first wall and a second wall opposite said first wall;

said second longitudinal guide slot is a substantially straight guide slot formed in said first wall of said housing; and said second longitudinal guide slot being a substantially straight guide slot formed in said second wall of said housing.

* * * * *